US005651320A

United States Patent [19]

Leisse et al.

[11] Patent Number: 5,651,320

[45] Date of Patent: Jul. 29, 1997

[54] BURNER FOR BURNING POWDERED FUEL

[75] Inventors: Alfons Leisse, Essen; Michael Streffing, Marl, both of Germany

[73] Assignee: Babcock Lentjes Kraftwerkstechnik GmbH, Oberhausen, Germany

[21] Appl. No.: 707,410

[22] Filed: Jan. 6, 1995

Related U.S. Application Data

[63] Continuation of Ser. No. 208,011, Mar. 8, 1994, abandoned.

[30] Foreign Application Priority Data

Jul. 30, 1993 [DE] Germany ..... 43 25 643.0

[51] Int. Cl.[6] ..... F23C 1/10

[52] U.S. Cl. ..... 110/262; 110/263; 110/265

[58] Field of Search ..... 110/260–265

[56] References Cited

U.S. PATENT DOCUMENTS

| | | | |
|---|---|---|---|
| 4,555,994 | 12/1985 | Voigt et al. | 110/262 |
| 4,807,541 | 2/1989 | Masai et al. | 110/262 |
| 4,836,772 | 6/1989 | La Rue | 110/263 |
| 4,838,185 | 6/1989 | Flament | 110/265 |
| 4,907,962 | 3/1990 | Azuhata et al. | 110/262 |
| 5,113,771 | 5/1992 | Rini et al. | 110/263 |
| 5,231,937 | 8/1993 | Kobayashi et al. | 110/265 |

*Primary Examiner*—Raymond A. Nelli
*Attorney, Agent, or Firm*—Max Fogiel

[57] ABSTRACT

A burner for burning powdered fuel in air. The air is divided into concentric annular currents. A tube (6) conveys primary air or gas. The tube is surrounded by another tube (12). The second tube conveys secondary air. The exit of the primary-air tube inside the secondary-air tube is surrounded by an annular baffle (26). The baffle is open at each end, has secondary air flowing through it, and extends axially beyond the primary-air tube as much as 25% of the tube's outside diameter. The thickness of the gap (25) between the primary-air tube and the baffle is at least 1.5% of that diameter.

11 Claims, 1 Drawing Sheet

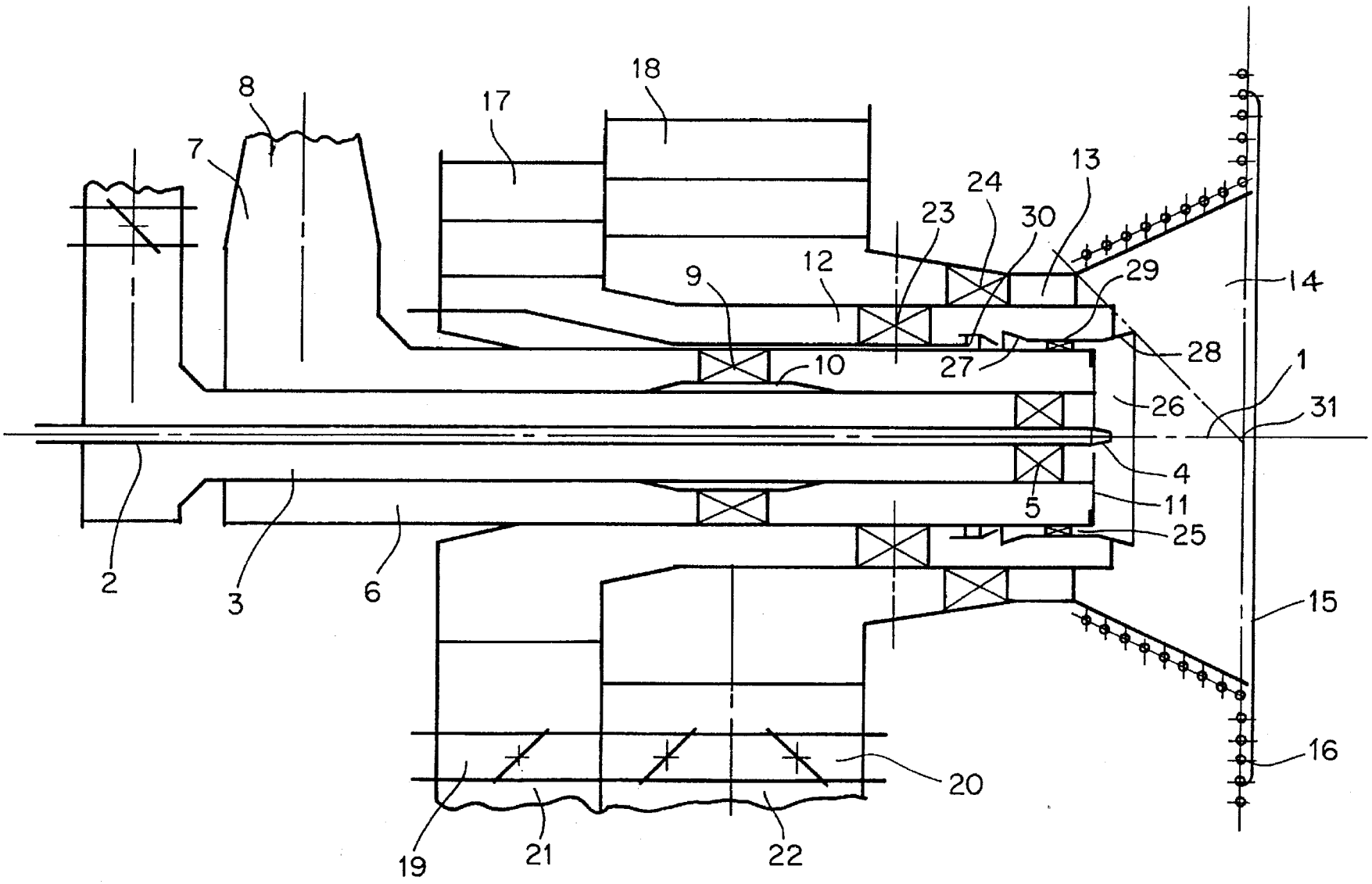
1
2
3
4
5
6
7
8
9
10
11
12
13
14
15
16
17
18
19
20
21
22
23
24
25
26
27
28
29
30
31

BURNER FOR BURNING POWDERED FUEL

The present application is a continuation of the parent application Ser. No. 208,011 filed Mar. 8, 1994, now abandoned.

BACKGROUND OF THE INVENTION

The preset invention concerns a burner for burning powdered fuel.

The air that is injected into such burners to facilitate combustion flows in several concentric annular currents. This makes it possible to suppress the occurrence of nitrogen oxides that accompanies the combustion of powdered fuels. The as yet unpublished German Application 4 217 879.7 describes a burner with that characteristic. The burner is distinguished by individually regulated air injection. The air enters at a tangent and the secondary and tertiary currents are distributed uniformly over the cross-section of flow. Vortex generators in the secondary and tertiary-air tubes make it possible to augment, diminish, or eliminate the rotation on each current separately. The thoroughness of the mixture of air and fuel in the combustion section can accordingly be adjusted to the type of fuel. The flow around that section will be stable.

SUMMARY OF THE INVENTION

The object of the present invention is to improve the generic burner to the extent that combustion will be more efficient and easier to control. The invention is primarily addressed to the chemistry and physics of formation and elimination of nitrogen oxides in the primary combustion section.

The well demarcated annular gap between the baffle and the primary-air tube allows some of the secondary air to arrive where the nucleus of the flame is ignited. This feature supports free ignition of the powdered fuel in the low-oxygen section. The baffle accordingly not only stabilizes the ignition at the burner and radially expands the flame to a limited extent. It also tends to deflect air, decelerating the reaction between the oxygen in the air of combustion and the fuel products. All these features inhibit the formation of nitrogen oxides.

The secondary air that flows through the gap in one practical embodiment of the invention can be regulated with a sliding annular choke. This mechanism makes it possible to adjust to the ignition behavior of various fuels to a considerable extent.

BRIEF DESCRIPTION OF THE DRAWINGS

One embodiment of the invention will now be specified with reference to the drawing. The sole FIG. 1 is a longitudinal section through a burner.

DESCRIPTION OF THE PREFERRED EMBODIMENTS

The burner is intended for burning coal dust. An oil-burner ignition lance 2 is accommodated along its longitudinal axis 1 inside an core-air tube 3. Lance 2 has an oil vaporizer 4 at the front. In the vicinity of oil vaporizer 4 and inside core-air tube 3 is a vortex generator 5.

Core-air tube 3 is surrounded by a wider concentric primary-air tube 6. Primary-air tube 6 communicates by way of a rear elbow 7 with a fuel line 8 that derives from an unillustrated coal mill. Fuel line 8 conveys a mixture of primary air or gas and coal dust to primary-air tube 6.

Accommodated inside primary-air tube 6 and somewhat remote from its exit is another vortex generator 9. Vortex generator 9 communicates with a bulk 10. Bulk 10 is mounted on core-air tube 3. Vortex generator 9 can be fixed or variable and induces a whirl or twist in the flow of primary air or gas coal dust. The concentration of coal dust in the primary air is accordingly maintained constant and the air is simultaneously forced outward. This action is reinforced by bulk 10.

Mounted around the exit from primary-air tube 6 is a ring 11 of components. One edge of ring 11 tapers radially inward into the flow of primary air or gas and coal dust, confusing the dust at the edge of primary-air tube 6. The air and its content are subjected to powerful turbulence within a small volume.

Primary-air tube 6 is in turn surrounded by a wider concentric secondary-air tube 12 and secondary-air tube 12 by a wider concentric tertiary-air tube. Tertiary-air tube 13 communicates with the burner's throat 14. Throat 14 merges into an aperture 15 in the wall 16 of a combustion section. Throat 14 is constructed out of the same type of pipes slabs as wall 16.

The rear end of the secondary-air tube 12 in each individual burner communicates with a spiraling inlet housing 17. Housing 17 communicates with an individual-air entry line 21. Individual-air entry line 21 accommodates a damper 19. Line 21 supplies tube 12 with secondary air. The rear end of the tertiary-air tube 13 in each individual burner similarly communicates with a spiraling inlet housing 18. Housing 18 communicates with an individual-air entry line 22. Individual-air entry line 22 accommodates a damper 20. Line 22 supplies tube 13 with tertiary air.

A barrier in the form of a rotating axial baffle 23 just upstream of the exit from secondary-air tube 12 and a similar baffle 24 just upstream of the exit from tertiary-air tube 13 regulate the rotation of the flow. Baffles 23 and 24 can be adjusted from outside by unillustrated rods and controls. The baffles impose a variable rotation on the secondary and tertiary airs. A non-adjustable baffle with a specific torque can be employed in a burner that always burns coal dust of the same composition and quality.

The exit end of primary-air tube 6 is surrounded by a wider concentric annular baffle 26. The gap 25 between tube 6 and baffle 26 is at least 1.5% of the outside diameter of the tube. Baffle 26 is a round cylinder with two flaring sections, an upstream section 27 and a downstream section 28. Upstream section 27 flares out no more than 45° and downstream section 28 no more than 25° from the longitudinal axis of the burner. At least upstream flaring section 27 and the straight midsection of annular baffle 26 are accommodated inside secondary-air tube 12. Annular baffle 26 divides the air flowing through secondary-air tube 12 into two streams, one of which flows through gap 25.

Annular baffle 26 is maintained concentric with primary-air tube 6 by braces 29. Braces 29 can extend parallel with the burner's longitudinal axis or preferably at an angle of up to 80° and preferably of 45° to it. Such an adjustment will rotate the air flowing through gap 25 powerfully enough to ensure satisfactory mixture. The secondary air flowing through gap 25 will mix in with the stream of coal dust and primary air rendered turbulent by the vortex generator 9 that communicates with bulk 10 and by the ring 11 that extends into primary-air tube 6. The flow of secondary air leaving gap 25 will simultaneously prevent the initial flame from expanding radially. Mixture of the secondary and tertiary airs with the fuel will accordingly be retarded, an effect that will be promoted by the variable rotation imposed on the flows.

An annular throttle 30 slides back and forth axially along primary-air tube 6 and into the entrance into baffle 26, blocking and unblocking gap 25. The percentage of secondary air flowing and hence the volume of secondary air in contact with the combustion products during their pyrolysis can accordingly be controlled.

Baffle 26 projects axially beyond the end of primary-air tube 6, which projects in turn beyond the end of tertiary-air tube 13. The section of baffle 26 that projects beyond primary-air tube 6 accounts for 25% of the outside diameter of the tube. The ratios between the cross-sections of the exit from tertiary-air tube 13, secondary-air tube 12, and baffle 26 are constant and depend on the process-engineering of the burner. In the most favorable case the outer edges of tertiary-air tube 13, secondary-air tube 12, and baffle 26 describe the surface of a circular cone with its apex 31 pointing downstream and with an apical angle of 40° to 60°.

We claim:

1. A burner for burning powdered fuel in air divided into concentric annular currents, comprising: a primary-air tube for conveying primary air or gas; a secondary-air tube surrounding said primary-air tube for conveying secondary air; said primary-air tube having an exit; an annular baffle surrounding said exit and said primary air and open at each end, said baffle being closable at an entrance thereof, said secondary air flowing through said exit, said baffle extending axially beyond said primary-air tube by substantially 25% of said primary-air tube's outside diameter, said primary-air tube and said baffle having an annular gap therebetween with a thickness that is at least 1.5% of said outside diameter for inserting a part of the secondary air into an ignition region of a combustion core to support early ignition of the powdered fuel in an oxygen deficient zone; and an annular throttle slidable back-and-forth axially along said primary-air tube and into an entrance of said baffle for varying the cross-section of said baffle to influence different ignition characteristics of different fuels over wide ranges, said baffle stabilizing said ignition and limiting expansion of a resulting flame in radial direction, said baffle delaying mixture reaction between the oxygen of the combustion air and products of combustion; braces for mounting said annular baffle on said primary-air tube, said braces extending at an angle not exceeding 80° to a stream of secondary air; said annular baffle projecting axially beyond said secondary-air tube.

2. A burner as defined in claim 1, including a rotating axial baffle forming a barrier upstream of the exit from said secondary-air tube.

3. A burner as defined in claim 2, wherein said rotating axial baffle is adjustable.

4. A burner as defined in claim 1, including a core-air tube inside said primary-air tube and receiving an ignition lance; and a vortex generator inside said primary-air tube and communicating with a bulk mounted on the core-air tube.

5. A burner as defined in claim 4, wherein said vortex generator is a fixed vortex generator.

6. A burner as defined in claim 4, wherein said vortex generator is a variable vortex generator.

7. A burner as defined in claim 1, including means at the exit of said primary-air tube for breaking up concentrations of dust at an edge of said primary-air tube.

8. A burner as defined in claim 1, including a tertiary-air tube surrounding said secondary-air tube for conveying tertiary air, said secondary-air tube projecting axially beyond said tertiary-air tube.

9. A burner as defined in claim 8, including a vortex generator in said tertiary-air tube.

10. A burner for burning powdered fuel in air divided into concentric annular currents, comprising: a primary-air tube for conveying primary air or gas; a secondary-air tube surrounding said primary-air tube for conveying secondary air; said primary-air tube having an exit; an annular baffle surrounding said exit and said primary air and open at each end, said baffle being closable at an entrance thereof, said secondary air flowing through said exit, said baffle extending axially beyond said primary-air tube by substantially 25% of said primary-air tube's outside diameter, said primary-air tube and said baffle having a gap therebetween with a thickness that is at least 1.5% of said outside diameter for inserting a part of the secondary air into an ignition region of a combustion core to support early ignition of the powdered fuel in an oxygen deficient zone; and an annular throttle slidable back-and-forth axially along said primary-air tube and into an entrance of said baffle for varying the cross-section of said baffle to influence different ignition characteristics of different fuels over wide ranges, said baffle stabilizing said ignition and limiting expansion of a resulting flame in radial direction, said baffle delaying mixture reaction between the oxygen of the combustion air and products of combustion; braces for mounting said annular baffle on said primary-air tube, said braces extending at an angle not exceeding 80 degrees to a stream of secondary air; said annular baffle having a downstream section flaring out from the longitudinal axis of the burner at an angle not exceeding 25 degrees; said baffle having an upstream section flaring out from the longitudinal axis of the burner at an angle not exceeding 45 degrees; a rotating axial baffle forming a barrier upstream of the exit from said secondary-air tube; said rotating axial baffle being adjustable; a core-air tube inside said primary-air tube and receiving an ignition lance; a vortex generator inside said primary-air tube and communicating with a bulk mounted on said core-air tube; means at the exit of said primary-air tube for breaking up concentrations of dust at an edge of said primary-air tube; a tertiary-air tube surrounding said secondary-air tube for conveying tertiary air, said secondary-air tube projecting axially beyond said tertiary-air tube; a vortex generator in said tertiary-air tube; said annular baffle projecting axially beyond said secondary-air tube; said tertiary-air tube, said secondary-air tube, and said annular baffle having outer edges describing a surface of a core with an apex of substantially 40 degrees to 60 degrees pointing downstream.

11. A burner for burning powdered fuel in air divided into concentric annular currents, comprising: a primary-air tube for conveying primary air or gas; a secondary-air tube surrounding said primary-air tube for conveying secondary air; said primary-air tube having an exit; an annular baffle surrounding said exit and said primary air and open at each end, said baffle being closable at an entrance thereof, said secondary air flowing through said exit, said baffle extending axially beyond said primary-air tube by substantially 25% of said primary-air tube's outside diameter, said primary-air tube and said baffle having an annular gap therebetween with a thickness that is at least 1.5% of said outside diameter for inserting a part of the secondary air into an ignition region of a combustion core to support early ignition of the powdered fuel in an oxygen deficient zone; and an annular throttle slidable back-and-forth axially along said primary-air tube and into an entrance of said baffle for varying the cross-section of said baffle to influence different ignition characteristics of different fuels over wide ranges, said baffle stabilizing said ignition and limiting expansion of a resulting flame in radial direction, said baffle delaying mixture reaction between the oxygen of the combustion air and products of combustion; braces for mounting said annular baffle on said primary-air tube, said braces extending at an angle not exceeding 80° to a stream of secondary air; said annular baffle projecting axially beyond said secondary-air tube; said annular baffle having a downstream section flaring out from the longitudinal axis of the burner at an angle not exceeding 25°; said baffle having an upstream section flaring out from the longitudinal axis of the burner at an angle not exceeding 45°; said tertiary-air tube, said secondary-air tube, and said annular baffle having outer edges describing a surface of a cone with an apex of substantially 40° to 60° pointing downstream.

* * * * *